US008840354B2

(12) United States Patent
Melancon, Jr. et al.

(10) Patent No.: US 8,840,354 B2
(45) Date of Patent: Sep. 23, 2014

(54) RETRACTABLE HOOK FOR ROLL-OFF CONTAINERS

(71) Applicant: Dropstor, LLC., Lynchburg, VA (US)

(72) Inventors: Dennis Wayne Melancon, Jr., Lynchburg, VA (US); Christian A. Meyer, Lynchburg, VA (US)

(73) Assignee: Weidmueller Interface GmbH & Co. KG, Detmold (DE)

( * ) Notice: Subject to any disclaimer, the term of this patent is extended or adjusted under 35 U.S.C. 154(b) by 154 days.

(21) Appl. No.: 13/655,293

(22) Filed: Oct. 18, 2012

(65) Prior Publication Data

US 2014/0110417 A1 Apr. 24, 2014

(51) Int. Cl.

| | |
|---|---|
| ***B60P 1/43*** | (2006.01) |
| ***B65D 88/12*** | (2006.01) |
| ***B65D 90/18*** | (2006.01) |
| ***B65D 88/54*** | (2006.01) |
| ***B65D 90/00*** | (2006.01) |

(52) U.S. Cl.

CPC ..... *B65D 88/123* (2013.01); *B65D 88/127* (2013.01); *B65D 90/18* (2013.01); *B65D 88/542* (2013.01); *B65D 90/0033* (2013.01)

USPC ..... 414/537; 414/557; 414/558

(58) Field of Classification Search

CPC ..... B60D 1/54; B60P 1/43; B66C 1/34

USPC ..... 414/462, 465, 469, 470, 537, 545, 557, 414/558; 220/660, 677; 294/82.13, 82.2, 294/82.1, 82.11

See application file for complete search history.

(56) References Cited

U.S. PATENT DOCUMENTS

| | | | | | |
|---|---|---|---|---|---|
| RE25,168 | E | * | 5/1962 | Crampton et al. | 172/272 |
| 3,112,833 | A | * | 12/1963 | Novotney | 414/557 |
| 3,638,811 | A | * | 2/1972 | Robinson | 414/558 |
| 4,061,103 | A | * | 12/1977 | Mampaey | 114/252 |
| 4,144,979 | A | * | 3/1979 | Leach et al. | 414/537 |
| 4,148,497 | A | * | 4/1979 | Genty | 280/479.1 |
| 4,252,373 | A | * | 2/1981 | Briggs | 298/17 R |
| 5,951,233 | A | * | 9/1999 | Boucher et al. | 414/495 |
| 6,846,150 | B2 | * | 1/2005 | Krause | 414/558 |
| 7,121,288 | B2 | * | 10/2006 | Jenkins | 134/201 |
| 7,168,906 | B2 | * | 1/2007 | Weatherford | 414/462 |

FOREIGN PATENT DOCUMENTS

| | | | | |
|---|---|---|---|---|
| EP | 0491241 | A1 * | 12/1991 | B60D 1/52 |

* cited by examiner

*Primary Examiner* — Saul Rodriguez
*Assistant Examiner* — Ashley Romano
(74) *Attorney, Agent, or Firm* — Lawrence E. Laubscher, Sr.; Lawrence E. Laubscher, Jr.; Robert D. Spendove

(57) ABSTRACT

A retractable tow hook assembly is connected with a rectangular storage container having a vertical ramp end wall hingedly connected at its bottom edge with the container for displacement about a horizontal pivot axis from an initial vertical closed position downwardly toward an inclined loading position in engagement with the ground. The tow hook assembly includes a support plate that is externally connected with the container adjacent the hinge connection, and a hook member that is displaceable relative to the support plate between an upwardly extending towing position for engagement by the loop of a towing cable when the ramp wall is in the vertical position, and a non-obstructing downwardly-displaced retracted position when the ramp wall is in the downwardly inclined loading position. A stop arrangement prevents displacement of the tow hook member beyond the extended position.

16 Claims, 6 Drawing Sheets

PRIOR ART

PRIOR ART

RETRACTABLE HOOK FOR ROLL-OFF CONTAINERS

REFERENCE TO RELATED APPLICATIONS

This application is a companion application to the earlier Melancon application Ser. No. 13/278,376 filed Oct. 21, 2011 entitled "Storage Bin for Transporting and Storing Bulk Landscaping Material, and Method".

BACKGROUND OF THE INVENTION

1. Field of the Invention

A retractable tow hook assembly is connected with a rectangular storage container having a vertical ramp end wall hingedly connected at its bottom edge with the container for displacement about a horizontal pivot axis from an initial vertical closed position downwardly toward an inclined loading position in engagement with the ground. The tow hook assembly includes a support plate that is connected externally with the container adjacent the hinge connection, and a tow hook member that is displaceable relative to the support plate between an upwardly extending towing position for engagement by the loop of a towing cable when the ramp wall is in the vertical position, and a non-obstructing downwardly-displaced retracted position when the ramp wall is in the downwardly inclined loading position.

2. Description of Related Art

Storage containers for delivering bulk material, landscaping material, and the like to a site, and for collecting waste at a site, are well known in the prior art. A storage container with a pair of swinging doors is shown in the Straka U.S. Pat. No. 6,910,574. Collapsible and sectional shipping and storage containers are shown by the patents to Csumrik U.S. Pat. No. 3,809,278 and Roberts U.S. Pat. No. 5,192,176. The provision of retractable covers for storage containers is shown by the patents to Willingham U.S. Pat. No. 5,125,713 and Aulick U.S. Pat. No. 7,484,789.

In the prior Hughes U.S. Pat. No. 7,819,270, a telescoping material handling bin is disclosed wherein a ramp end wall is pivoted downwardly to permit a loading/unloading vehicle to be driven up the ramp for engagement with the bulk material contained in the bin.

One problem that occurs during the use of such known bulk material handling and storage bins is that of transporting the bin to a given landscaping site, and removing the bin from the transporting vehicle without the bulk material shifting within the container to block the access doors, and/or to be discharged from an opening in a container wall.

In the aforementioned Melancon patent application, a storage container is disclosed having a ramp end wall that is pivotally connected at its lower edge to the container, thereby to permit the ramp wall to be pivoted from a vertical position downwardly toward an inclined loading position, whereby a front end loader may be driven up the ramp for the removal of bulk material stored in the container. The storage container of this application was provided with horizontal connecting bars for connection with a hook member fastened to the end of the towing cable on a flatbed transport truck.

Since the towing cables of many flatbed trucks are provided with loops at the ends of the tow cable for connection with hooks rigidly secured to the storage containers, the problem arises that the rigidly connected hooks of the prior art would interfere with the downward displacement of a hinged ramp wall toward the inclined loading position. To solve this problem, the need for a pivotal hook arrangement became apparent, wherein the hook member could by displaced from the vertical position toward a retracted concealed position that would not interfere with the displacement of the ramp wall between its inclined loading and vertical transport positions.

SUMMARY OF THE INVENTION

Accordingly, a primary object of the present invention is to provide a retractable tow hook assembly connected with a rectangular storage container having a vertical ramp end wall hingedly connected at its bottom edge with the container body for displacement about a horizontal pivot axis from an initial vertical closed position downwardly toward an inclined loading position in engagement with the ground, said tow hook assembly including a support plate that is externally connected with the container body adjacent the hinge connection, and a hook member that is displaceable relative to the support plate between an upwardly extending towing position for engagement by the loop of a towing cable when the ramp wall is in the vertical position, and a non-obstructing downwardly-displaced retracted position when the ramp wall is in the downwardly inclined loading position.

According to a more specific object of the invention, the tow hook member is pivotally connected with the support plate for displacement between the upwardly extending towing position and the downwardly displaced retracted position. In one embodiment, the tow hook member is gravity-biased toward the retracted position, while in the preferred embodiment, the tow hook member is spring-biased toward the upwardly extending towing position.

According to a more specific object of the invention, a stop arrangement is provided for preventing pivotal movement of the hook member beyond the extended position.

Another object of the invention is to provide support means for supporting an intermediate portion of ramp wall relative to ground when the ramp wall is in the inclined loading position.

According to a further object, the pivot means connecting the tow hook member to the container includes a pair of vertical parallel spaced metal stanchion bars having upper ends welded to the lower surface of a metal support plate, said stanchion bars extending downwardly from said support plate lower surface parallel with and on opposite sides of a slot contained in an edge portion of the support plate. A horizontal pivot shaft has opposite ends supported by said stanchion bars, respectively, and the hook member has a first end extending between and parallel with said stanchion bars, said pivot shaft extending through a pivot opening contained in said hook member first end.

A further object of the invention is to provide a storage container including a pair of horizontal parallel spaced longitudinally-extending base beams centrally arranged below said bottom wall, said beams having end portions that extend outwardly beyond said ramp wall, said hook member assembly support plate being mounted on said base beam extending end portions. Additionally, the piston and cylinder hydraulic motor means for operating said ramp wall between the vertical and inclined positions are connected between the external surface of the ramp wall and the base beam extending end portions.

According to a preferred embodiment of the invention, spring means normally bias the pivotal tow hook member toward the upwardly extending towing position, with the tow hook member being automatically pivoted downwardly toward the retracted position by the ramp wall as it pivots downwardly from the vertical closed position toward the loading position. To protect the spring-biased tow hook member, it is pivotally mounted in a recess defined in the support plate between the base beams of the container. Protective pegs are provided that extend upwardly from the recess bottom wall on opposite side of the hook member.

BRIEF DESCRIPTION OF THE DRAWINGS

Other objects and advantages of the invention will become apparent from a study of the following specification, when viewed in the light of the accompanying drawing, in which.

DETAILED DESCRIPTION OF THE INVENTION

Figure 1:
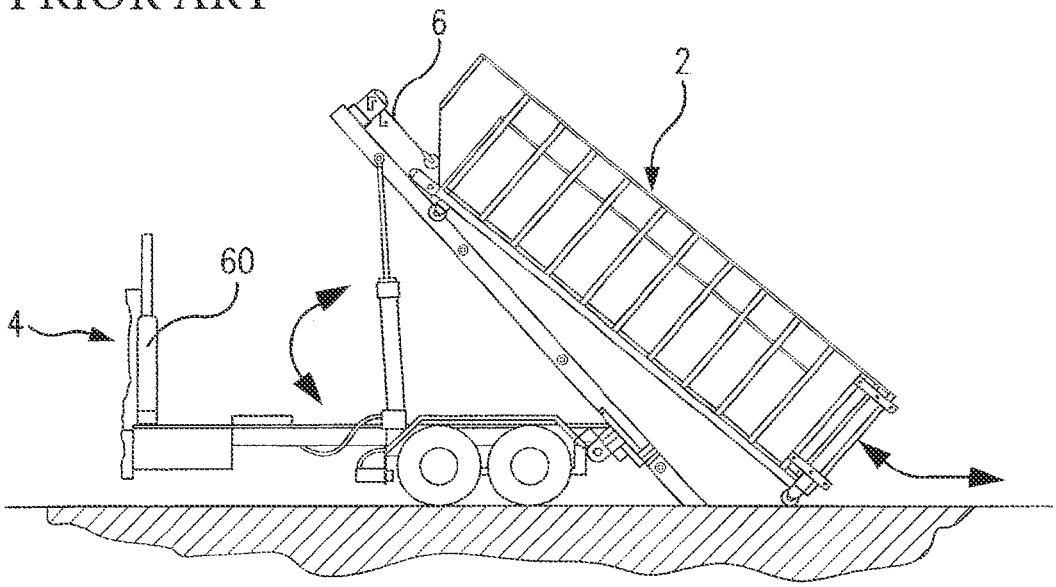
FIG. 1 PRIOR ART
FIG. 1 illustrates the conventional tilt bed truck means for transporting a storage container to a desired work site.

Referring first more particularly to FIG. 1, the rectangular storage container 2 for bulk material, landscaping material, waste material and the like is generally transported to a desired site by a tilt-type flatbed trailer 4. A cable 6 is used for loading the container on, and unloading the container from, the tilting trailer bed. Customarily, the cable 6 has a hook that is adapted for connection with a bar on the container, such as the bars 41 and 42 on the prior storage container of FIGS. 2 and 3. Alternatively, the cable includes a tow loop that is adapted for connection with a hook member on the container, as will be described below with reference to FIG. 4. In accordance with the present invention, the tow hook member is designed for pivotal displacement between an operable extended position, and a retracted non-obstructing position, thereby to permit a hingedly connected ramp wall to be downwardly displaced toward an inclined loading position relative to ground.

Figure 2:
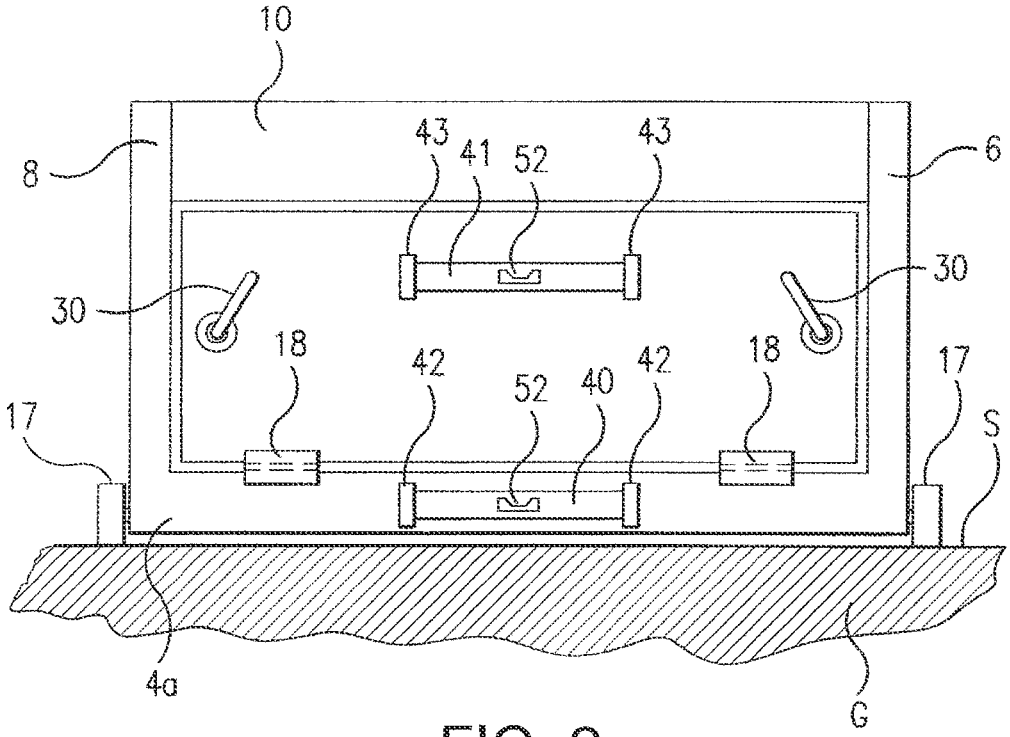
FIGS. 2 and 3 are rear elevation and detailed side views of a prior embodiment of the invention adapted for use with a hook-type towing cable.
Figure 3:
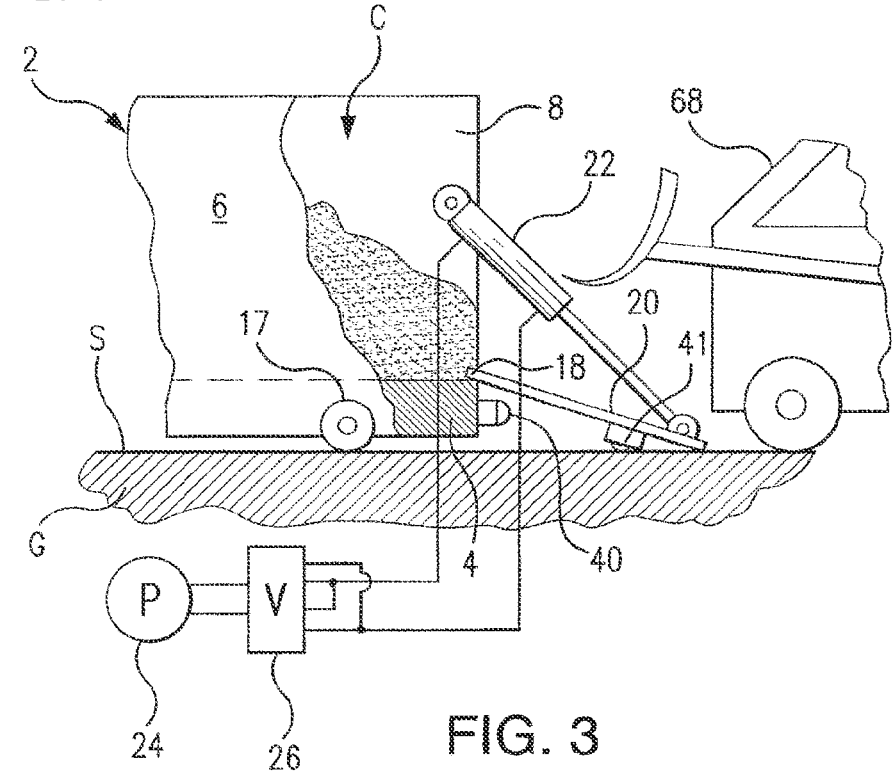

Briefly, in the prior container of FIGS. 2 and 3, which is the subject of the prior Melancon application Ser. No. 13/278,376, the storage container 2 includes a bottom wall 4 supported by rollers 17, a pair of side walls 6 and 8, an end wall 10, and a ramp wall 20 that is hingedly connected with the container by hinge means 18. The ramp wall is displaceable from the vertical position of FIG. 2 to the inclined loading position of FIG. 3, thereby to permit a front-end-loading vehicle 68 to drive up the ramp wall to remove landscaping materials and the like from the storage chamber C. Hydraulic motor means 22, 24 and 26 are operable to raise and lower the ramp wall, and locking means 30 serve to lock the ramp wall to the container.

In this prior invention, there are provided a pair of transport bars 40 and 41 that are rigidly connected with the container frame and with the ramp wall, respectively, thereby to permit the container to be transported as a result of the engagement between a hook on the end of the towing cable 6 and a selected one of the towing bars 40 and 41.

Figure 4:
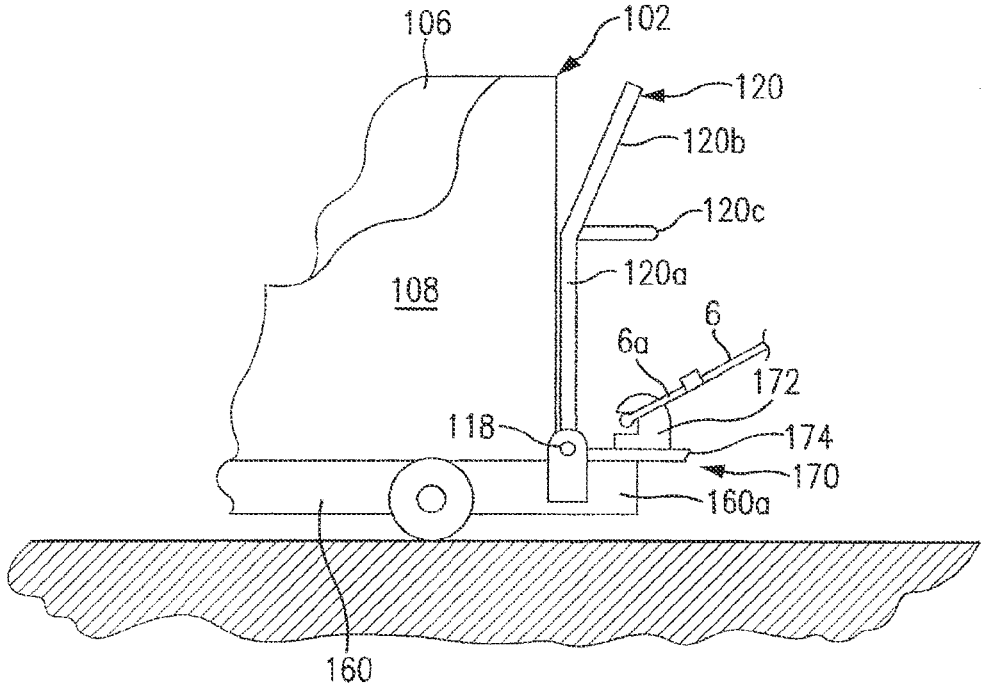
FIG. 4 is a detailed view of a first ramp wall embodiment of the present invention adapted for use with a loop-type towing cable, with the ramp wall in the vertical closed position, and the tow hook member in the upwardly extended towing position.
Figure 5:
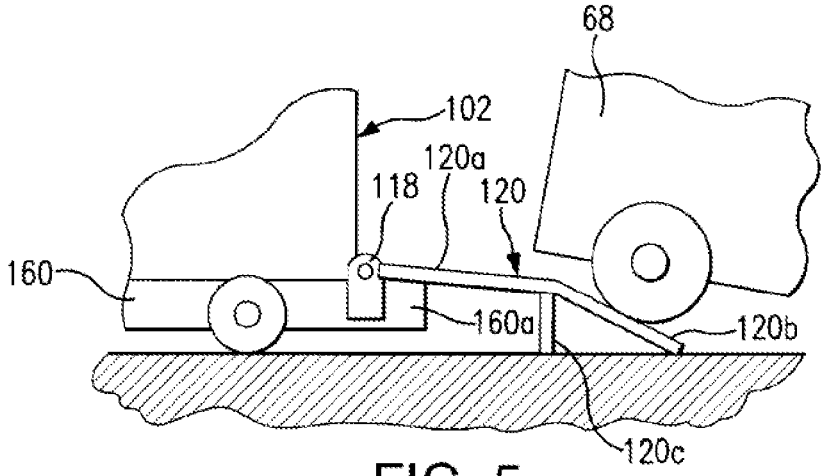
FIG. 5 illustrates the apparatus of FIG. 4 with the ramp wall in the downwardly inclined loading position, the tow hook member being concealed in the non-obstructing retracted position.

Referring now to FIGS. 3 and 4, in h a first embodiment of the present invention, the storage container 102 includes a rectangular ramp wall 120 that is hingedly connected at its lower edge with the container by hinge means 118, thereby to permit hinged displacement of the ramp wall between the vertical position of FIG. 4, and the inclined loading position of FIG. 5. As shown in FIG. 4, the ramp wall 120 has a generally vertical lower first section **120*a*, and an upper second section 120*b* that extends outwardly of the container at an obtuse angle relative to the lower first section. The ramp wall is provided with rigid foot means 120*c* that support the central portion of the ramp wall when the ramp wall is in the inclined loading position of FIG. 5**.

As will be explained in greater detail below, the container 102 includes a pair of parallel spaced base beams 160 that extend longitudinally beneath the container bottom wall. These base beams include end portions **160*a* that protrude longitudinally outwardly beyond the ramp wall 120. In accordance with a characterizing feature of the present invention, a pivotal hook assembly 170 is mounted on the upper surfaces of the base beam end portions, thereby to provide means for connecting the loop portion 6*a* of a tow cable 6 with the container. The pivotal assembly includes a hook member 172 that is pivotally connected with a metal support plate 174 that is welded to the upper surfaces of the base beam ends 160*a*. In order to prevent interference with the ramp wall during the lowering thereof from the vertical position of FIG. 4 to the inclined loading position of FIG. 5, the hook member 172 is pivotally displaceable relative to the support plate 172 from the extended vertical transport position of FIG. 4 toward the concealed retracted position of FIG. 5**.

Figure 6:
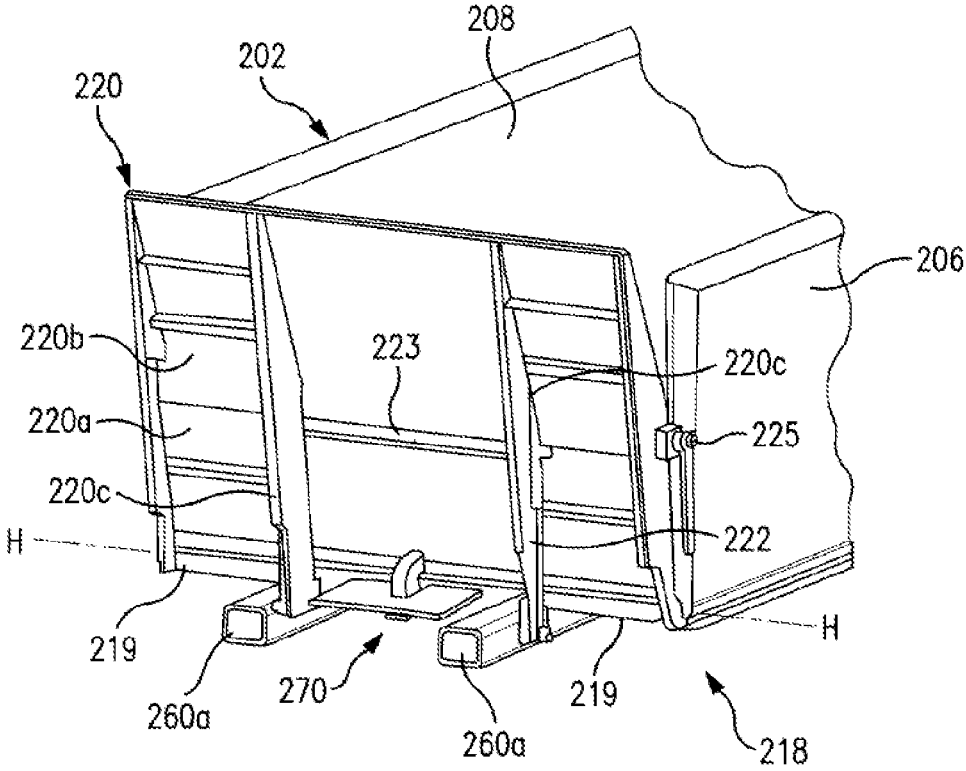
FIG. 6 is a detailed perspective view of a second ramp wall embodiment according to the present invention when in the vertical position, and with the pivotal hook member in the upwardly extended position.
Figure 7:
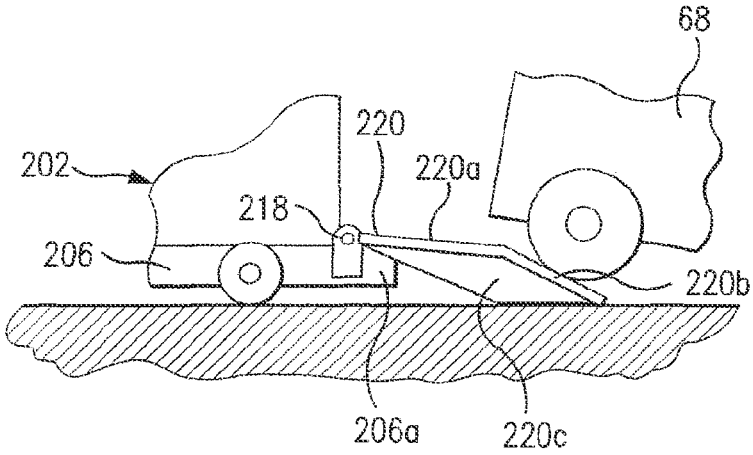
FIG. 7 is a detailed side elevation view of the apparatus of FIG. 6 with the ramp wall in the inclined loading position, the tow hook member being concealed in the non-obstructing retracted position.
Figure 8:
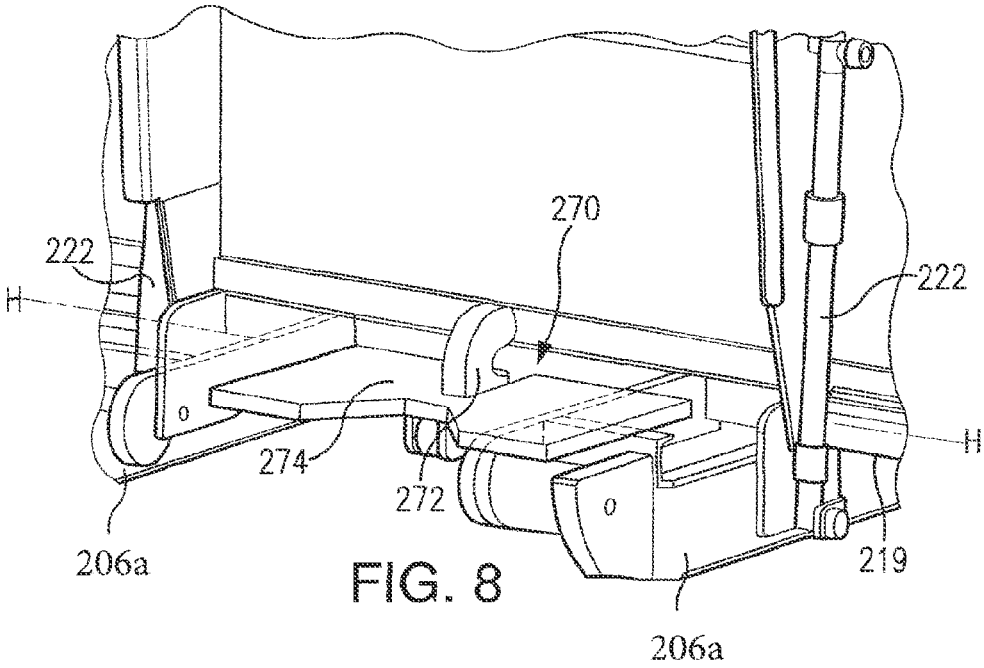
FIG. 8 is a detailed perspective view of the apparatus of FIG. 6.
Figure 9:
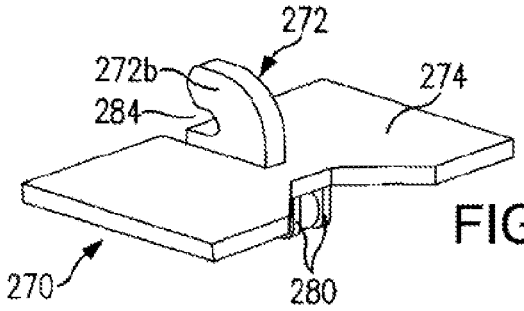
FIG. 9 is a perspective view of the pivotal gravity-biased embodiment of the tow hook apparatus.

In the embodiment of FIGS. 6-8, the storage container 202 includes a pair of base beams 206 having ends **206*a* that extend outwardly beyond the ramp wall 220, the pivotal hook assembly 270 including a support plate 274 that is welded to the upper surfaces of the base beams, and a pivotally connected hook member 272. The ramp wall 220 of this embodiment is reinforced by support flanges 220*c* that extend normal to the ramp wall hinge axis H-H defined by the collinear longitudinally-spaced pivot shafts 219, which support flanges are secured to the external surfaces of the first and second ramp wall sections 220*a* and 220*b*. The support flanges support the intermediate portion of the ramp wall relative ground when the ramp wall is in the inclined loading position of FIG. 7. The two hydraulic piston and cylinder motor means 222 for raising and lowering the ramp wall 220 are connected between the base beam ends 206***a* and the ends of the bar 223 secured to the external surface of the ramp wall. Fastening means 225 are provided for fastening the sides of the ramp wall to the adjacent ends of the container side walls.

Figure 10:
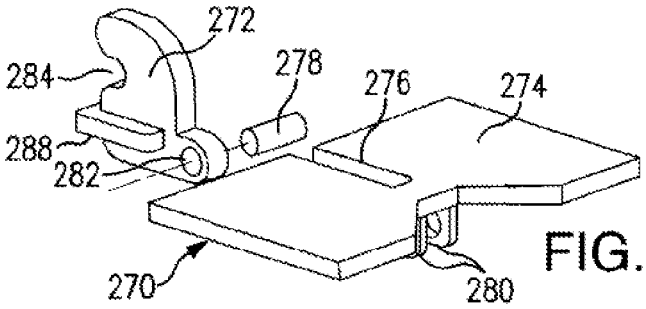
FIG. 10 is an exploded view of FIG. 9.
Figure 13:
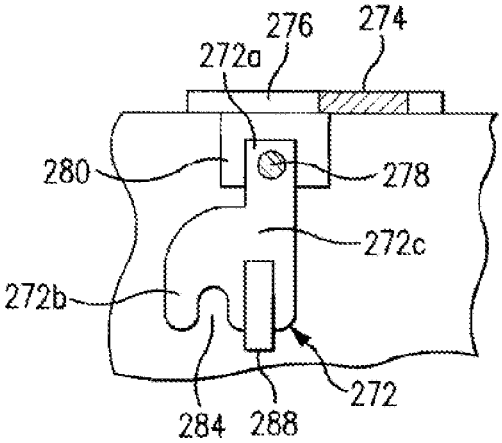
FIG. 13 is a sectional view taken along line 13-13 of FIG. 12.

Referring now to FIGS. 9-13, the horizontal planar rectangular support plate 274 is formed from a rigid metal material and includes a transverse edge portion that contains a slot 276 that extends in a vertical plane normal to the hinge axis H. Pivotally connected with the plate by a pivot pin 278 (FIG. 10) is the rigid metal hook member 272 that is pivotally displaceable between the normal gravity-biased concealed retracted position of FIGS. 12 and 13, and the upper extended position of FIGS. 9-11. The pivot pin 278 has ends that are supported within opposed openings contained in vertical parallel stanchion plates 280 that are parallel with, and arranged on opposite sides of, the slot 276, the upper ends of the stanchion plates being welded to the lower surface of the support plate 274. As best shown in FIGS. 10 and 13, the pivot pin 278 extends through an opening contained in one end 272*a* of the hook member, and the other end 272*b* of the hook member contains a recess 284. The hook member 272 may be manually pivoted upwardly from the non-obstructing retracted position of FIG. 13 toward the upwardly extended towing position of FIG. 9, whereupon the body portion 272*c* of the hook member is contained within the slot 276, and the second end portion 272*b* of the hook member extends upwardly above the upper surface of the support plate 274. In this case, the recess 284 is positioned above the support plate for connection with the tow loop of the tow cable 6 (as shown in FIG. 4).

Figure 11:
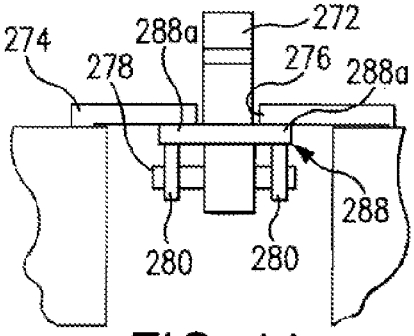
FIG. 11 is a detailed front elevation view of the tow hook assembly of FIG. 9 connected across the upper surfaces of the longitudinal center beams of the storage container, the hook member being in the upwardly extended position.
Figure 12:
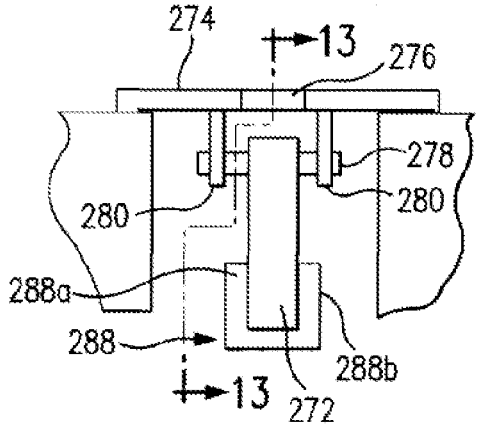
FIG. 12 is a front elevation view with the tow hook member in the non-obstructing retracted position.

In order to limit the extent of travel of the hook member 272, the hook member is provided with stop means 288 including a pair of laterally outwardly extending stop bars 288*a* that engage the lower surface of the support plate (as shown in FIG. 11) when the hook member is in the upwardly extended position. These stop means 288 may be in the form of a U-shaped component welded to the hook member (FIG. 12), or as a unitary stop plate secured within, and extending on opposite sides from, a corresponding slot contained in the hook member.

Figure 14:
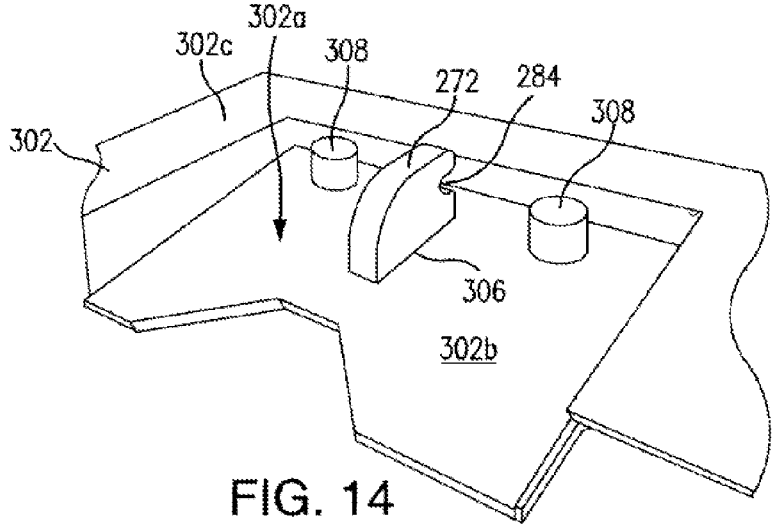
FIG. 14 is a perspective view of the preferred spring-biased embodiment of the invention.
Figure 15:
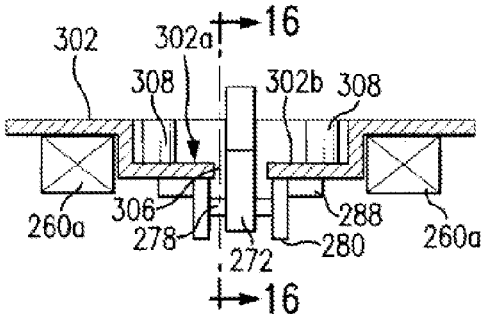
FIG. 15 is a transverse sectional view of the apparatus of FIG. 14.
Figure 16:
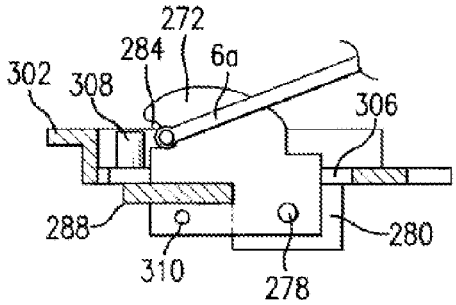
FIG. 16 is a sectional view taken along line 16-16 of FIG. 15.
Figure 17:
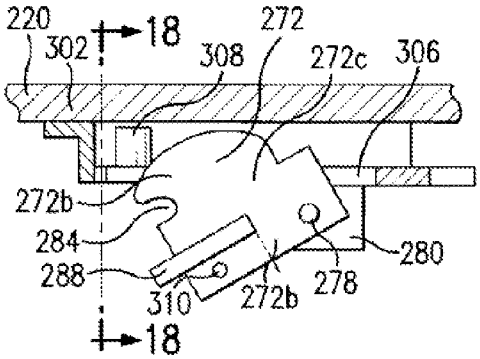
FIG. 17 is a sectional view illustrating the tow hook member of FIG. 16 in the retracted position.

Referring now to FIGS. 14-18, in accordance with the preferred embodiment of the invention, the tow hook member 272 is normally biased upwardly by spring means 300 (FIG. 18) toward the upwardly extended towing position shown in FIGS. 14-16, thereby to permit engagement of the towing cable loop with the recess 284 contained in the tow hook. In this embodiment, the support plate 302 contains a protective central recess 302*a* that extends downwardly between the support beams 260*a* of the container. The stanchion plates 280 are welded to the lower surface of the recess bottom wall 302*b* on opposite sides of the slot 306 contained in the recess bottom wall 302*b*. Protective metal pegs 308 are welded to the upper surface of the recess bottom wall 302*b* on opposite sides of the slot 306, which pegs terminate at their upper ends in end surfaces that are generally coplanar with the outer peripheral portion 302*c* of the support plate that is seated upon the container base beams 260*a*.

Figure 18:
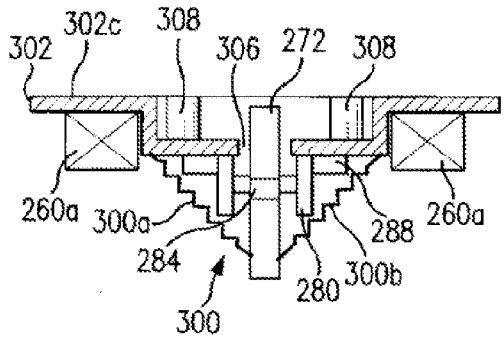
FIG. 18 is a sectional view taken along line 18-18 of FIG. 17.

A pair of tension springs 300*a* and 300*b* are provided having first ends connected with an opening 310 contained in the lower portion of the tow hook 272, and second ends connected with the bottom surface of the recess bottom wall 302*b* on opposite sides of the slot 306, respectively (as best shown in FIG. 18). These tension springs bias the tow hook pivotally upwardly toward the upwardly extended towing position of FIG. 16. When the container ramp wall 220 is pivoted downwardly toward the loading position of FIG. 7, the tow hook 272 of FIG. 16 is engaged by the ramp wall and is automatically pivoted downwardly against the restoring force of the tension springs 300*b* toward the non-obstructing retracted position of FIGS. 17 and 18. When the ramp wall is returned to its vertical position relative to the container body, the tow hook is returned by the spring means 300 to the towing position of FIG. 16.

It is important to note that although the retractable hook invention has been disclosed for use in connection with roll-off containers of the type including a downwardly pivotable ramp wall, it is apparent that the retractable hook invention, standing alone, could be used with all types of roll-off containers.

Furthermore, although the ramp wall has been illustrated as serving as an end wall for the storage container, it is apparent that, in addition to the ramp wall, a movable vertical end wall could be provided. In any event, when the ramp wall is in the inclined loading position and the adjacent end of the container is open, the front end loader may be driven up the ramp for entry into the storage container. The front end loader can be transported within the storage container when the storage container is transported by the flat bed truck 4. Moreover, although the hook member has been disclosed as being gravity-biased downwardly toward the non-obstructing retracted position, or spring-biased upwardly toward the upwardly extending towing position, it is apparent that the hook member could be mechanically displaced between its recessed and extended positions. Also, instead of a pivotally displaceable tow hook member, the tow member could be retractably displaceable by cam guide means, slide guide means, or the like.

While in accordance with the provisions of the Patent Statutes the preferred forms and embodiments of the invention have been illustrated and described, it will be apparent to those skilled in the art that changes may be made without deviating from the invention described above.

What is claimed is:

1. A retractable tow hook assembly for use in transporting a storage container, comprising:

(a) a rectangular storage container (102; 202), including:

(1) a container body having a horizontal bottom wall, a pair of vertical parallel spaced side walls, and a vertical first end wall at one end of the container, said bottom, side and first end walls cooperating to define an open-ended chamber;

(2) a normally vertical generally rectangular ramp wall (120; 220) arranged at the other end of the container to close the other end of said chamber, said ramp wall having a horizontal lower first edge portion and a horizontal upper second edge portion; and (3) hinge means (118; 218) connecting said ramp wall lower first edge portion with said container, thereby to permit hinged displacement of said ramp wall about a horizontal hinge axis from an initial vertical closed position toward a downwardly inclined loading position in which said upper second edge portion is in engagement with the ground;

(b) a pivotal tow hook assembly, comprising:

(1) a horizontal generally-rectangular rigid metal support plate (274; 302) having upper and lower surfaces, a pair of parallel spaced side edges, and a pair of parallel spaced end edges, said support plate containing a slot (276; 306) that extends from one of said end edges in parallel spaced relation between said side edges;

(2) a planar vertical tow hook member (272) having a central body portion (272*c*), and first (272*a*) and second (272*b*) end portions; and (3) pivot means (278) connecting said tow hook member first end portion with said support plate lower surface adjacent said slot, thereby to provide pivotal movement of said hook member about a horizontal pivot axis;

(4) said hook member being pivotally displaceable between a retracted position extending downwardly from said support plate, and an extended towing position in which said body portion extends upwardly through said slot with said hook member second end portion extending upwardly above said support plate upper surface;

(5) said hook member second end portion, when said hook member is in said extended towing position, having a generally vertical edge portion that is directed away from said slot, said vertical edge portion containing a towing recess (284);

(c) said support plate being connected with said storage container adjacent said hinge means on the side thereof remote from said container body such that said hook member is operable between said extended towing and said retracted positions when said ramp wall is hingedly displaced between said vertical and said loading positions, respectively.

2. A retractable tow hook assembly as defined in claim 1, wherein said hook member is biased by gravity toward said retracted position.

3. A retractable tow hook assembly as defined in claim 1, and further including:

(d) spring means (300) biasing said tow hook member toward said extended towing position.

4. A retractable tow hook assembly as defined in claim 3, wherein said spring means comprise a pair of tension springs (302*a*, 302*b*) having first ends connected with said tow hook member first end portion, and second ends connected with said support plate on opposite sides of said tow hook member.

5. A retractable tow hook assembly as defined in claim 1, wherein said ramp wall includes a lower first planar section (220*a*) containing said lower horizontal edge portion, and an upper second planar section (220*b*) containing said upper second horizontal edge portion, said planar sections being arranged at an obtuse angle with the upper section extending outwardly away from said container chamber, whereby when said ramp wall is in said downwardly inclined position, the angle of inclination of said ramp wall second section relative to ground is greater than the angle of inclination of said ramp wall first section relative to ground.

6. A retractable tow hook assembly as defined in claim 5, and further including:

(d) support foot means (120*c*; 220*c*) mounted on said ramp wall for supporting engagement with the ground when said ramp wall is in said inclined loading position.

7. A retractable tow hook assembly as defined in claim 6, wherein said support foot means comprises, when said ramp wall is in said inclined loading position, transverse bar support foot means (120*c*) that extends downwardly adjacent the junction between said ramp wall sections for engagement with the ground.

8. A retractable tow hook assembly as defined in claim 6, wherein said support foot means comprises, when said ramp wall is in said inclined loading position, support flanges (220*c*) that extend normal to said hinge axis to bridge and reinforce the junction between said ramp wall sections.

9. A retractable tow hook assembly as defined in claim 1, wherein said storage container further includes a pair of horizontal parallel spaced longitudinally-extending base beams (260) centrally arranged below said bottom wall, said base beams having end portions (260*a*) that extend outwardly beyond said ramp wall, said hook member assembly support plate being mounted on said base beam extending end portions.

10. A retractable tow hook assembly as defined in claim 9, and further including piston and cylinder hydraulic motor means (222) connected between said base beam extending end portions and the external surface of said ramp wall for displacing said ramp wall between said vertical closed position and said downwardly inclined loading position.

11. A retractable tow hook assembly as defined in claim 9, wherein said support plate contains between said base beam end portions a downwardly extending recess (302*a*) having a horizontal bottom wall that contains said slot.

12. A retractable tow hook assembly as defined in claim 11, and further including at least two protective pegs (308) secured at their lower ends to, and extending upwardly from, said recess bottom wall on opposition sides of said slot, the upper ends of said pegs terminating a the level of the upper surface of said support plate.

13. A retractable tow hook assembly as defined in claim 1, wherein said pivot means includes:

(1) a pair of vertical parallel spaced metal stanchion plates (280) having upper ends welded to said support plate lower surface, said stanchion plates extending downwardly from said support plate lower surface parallel with and on opposite sides of said slot; and (2) a horizontal pivot shaft (278) having opposite ends supported by said stanchion plates, respectively, said hook member first end extending between and parallel with said stanchion plates, said pivot shaft extending through a pivot opening contained in said hook member first end portion.

14. A retractable tow hook assembly as defined in claim 13, and further including:

(g) stop means (288) limiting the pivotal movement of said hook member in said given direction beyond said second position.

15. A retractable tow hook assembly as defined in claim 14, wherein said stop means comprises a pair of stop bars (288*a*, 288*b*) extending from the sides of said hook member for contiguous engagement with said support plate lower surface when said hook member is in said second position.

16. A retractable hook assembly, comprising:

(a) a horizontal generally-rectangular rigid metal support plate (274; 302) having upper and lower surfaces, a pair of parallel spaced side edges, and a pair of parallel spaced end edges, said support plate containing a slot (276; 306) that extends in parallel spaced relation between, said side edges;

(b) a planar vertical hook member (272) having a central body portion (272*c*), and first (272*a*) and second (272*b*) end portions;

(c) connecting means connecting said hook member with said support plate for pivotal displacement between an extended towing position in which said hook member second end portion extends upwardly through said slot, and a retracted position in which said second end portion is displaced downwardly below said support plate upper surface;

(d) said hook member second end portion, when said hook member is in said extended position, having a generally vertical edge portion that is directed away from said slot, said vertical edge portion containing a towing recess (284) for receiving the loop of a tow cable;

(e) spring means (300) biasing said hook member toward said extended towing position; and (f) a roll-off container (202) having a horizontal bottom wall, and vertical side and end walls cooperating with said bottom wall to define a chamber, one of said end walls comprising a ramp wall (220) that is hingedly connected with said bottom wall for pivotal downward displacement about a horizontal hinge axis from a vertical position toward a downwardly inclined loading position, said support plate being externally secured to said container adjacent said hinge axis such that when said ramp wall is hingedly displaced from said vertical position toward said downwardly inclined loading position, said hook member is pivoted downwardly by said ramp wall from said extended towing position toward said retracted position.

* * * * *

UNITED STATES PATENT AND TRADEMARK OFFICE

CERTIFICATE OF CORRECTION

PATENT NO. : 8,840,354 B2
APPLICATION NO. : 13/655293
DATED : September 23, 2014
INVENTOR(S) : Melancon, Jr. et al.

It is certified that error appears in the above-identified patent and that said Letters Patent is hereby corrected as shown below:

On the title page item (73), should be: --Dropstor, LLC, of Lynchburg, Virginia--

Signed and Sealed this
Eighth Day of September, 2015

Michelle K. Lee

Michelle K. Lee
*Director of the United States Patent and Trademark Office*